US008047540B2

(12) United States Patent
Daigo et al.

(10) Patent No.: US 8,047,540 B2
(45) Date of Patent: Nov. 1, 2011

(54) RECORDING MEDIUM CONVEYING DEVICE AND IMAGE FORMING APPARATUS

(75) Inventors: Hironori Daigo, Osaka (JP); Yuya Shimohora, Osaka (JP)

(73) Assignee: Kyocera Mita Corporation (JP)

( * ) Notice: Subject to any disclaimer, the term of this patent is extended or adjusted under 35 U.S.C. 154(b) by 445 days.

(21) Appl. No.: 12/418,193

(22) Filed: Apr. 3, 2009

(65) Prior Publication Data

US 2009/0309288 A1 Dec. 17, 2009

(30) Foreign Application Priority Data

Jun. 11, 2008 (JP) ..... 2008-152438
Mar. 6, 2009 (JP) ..... 2009-052874

(51) Int. Cl.
*B65H 5/00* (2006.01)

(52) U.S. Cl. ..... 271/264; 271/272; 399/21; 399/23; 399/393; 399/402; 399/108; 399/110; 399/124

(58) Field of Classification Search ..... 271/264, 271/272–274, 145; 399/21, 23, 393, 402, 399/108, 110, 124
See application file for complete search history.

(56) References Cited

U.S. PATENT DOCUMENTS 4,873,554 A * 10/1989 Greco, Jr. ..... 399/124
5,134,443 A * 7/1992 Sumi et al. ..... 399/121
5,327,206 A * 7/1994 Ueda et al. ..... 399/402
5,652,942 A * 7/1997 Iseki et al. ..... 399/21
6,711,377 B2 * 3/2004 Yamagishi ..... 399/401
6,722,647 B2 * 4/2004 Kato et al. ..... 271/3.03
6,837,489 B2 1/2005 Kim
7,168,701 B2 * 1/2007 Isaka et al. ..... 271/273
7,272,343 B2 * 9/2007 Takahashi et al. ..... 399/124
7,883,087 B2 * 2/2011 Kitano ..... 271/258.01
7,950,659 B2 * 5/2011 Matsushima ..... 271/264
2002/0074720 A1 * 6/2002 Kato et al. ..... 271/264
2010/0329730 A1 * 12/2010 Fujita ..... 399/110

FOREIGN PATENT DOCUMENTS

JP 58183543 A * 10/1983
JP 07-013392 1/1995

* cited by examiner

*Primary Examiner* — Kaitlin Joerger
*Assistant Examiner* — Prasad Gokhale
(74) *Attorney, Agent, or Firm* — McDonnell Boehnen Hulbert & Berghoff LLP

(57) ABSTRACT

A recording medium conveying device including a body portion capable of being mounted to and removed from a body of an apparatus, the body portion being provided with a conveying roller; a knob member disposed at a side at which the body portion is removed, the knob member allowing manual rotation of the conveying roller; and a handle member for mounting the body portion to and removing the body portion from the body of the apparatus. The handle member is rotatably supported so as to move between a first position and a second position, The knob member is connected to a rotating shaft of the conveying roller so as to move along a direction in which the body portion is removed. The handle member moves between the first position and the second position in response to an accommodation operation and a draw-out operation of the knob member.

20 Claims, 16 Drawing Sheets

【FIG.1】
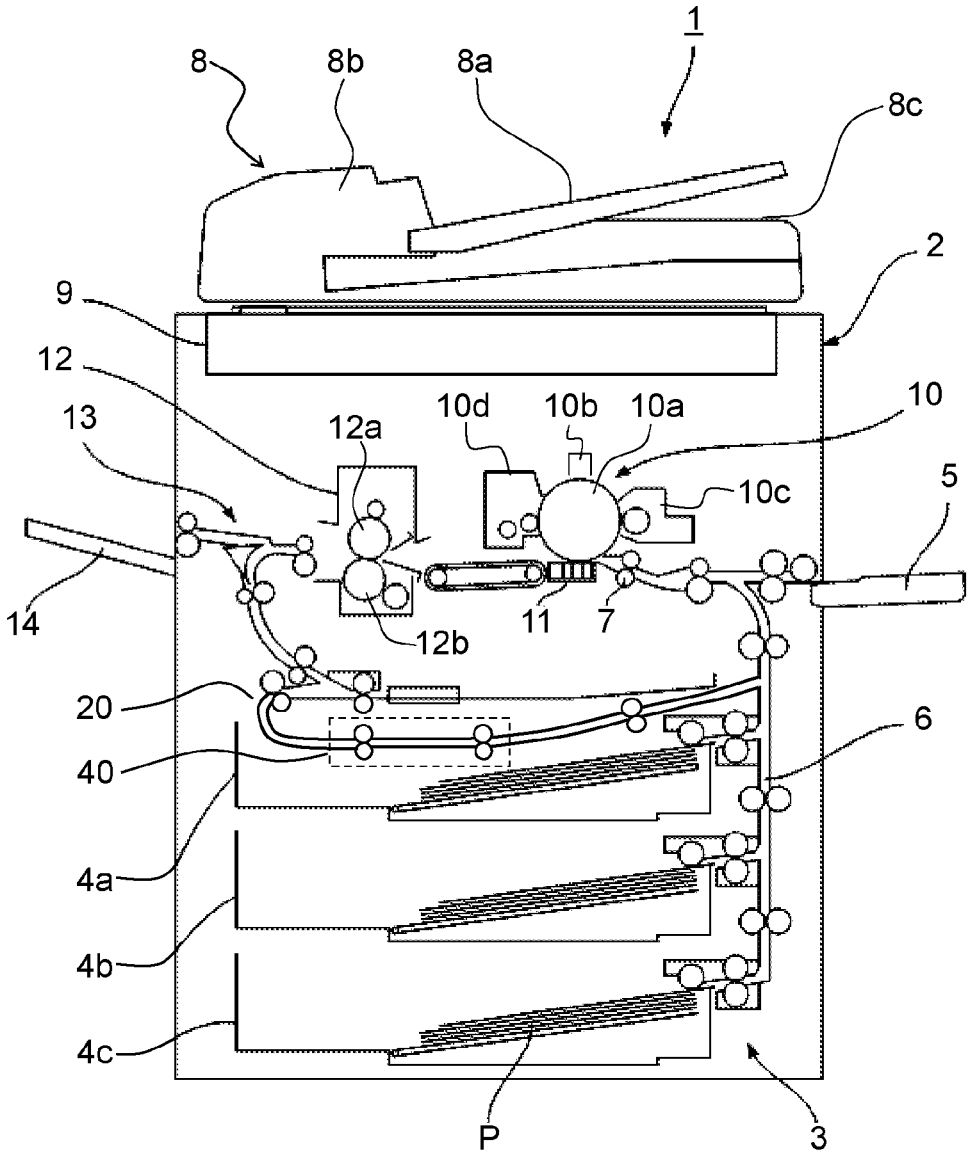

【FIG.2】
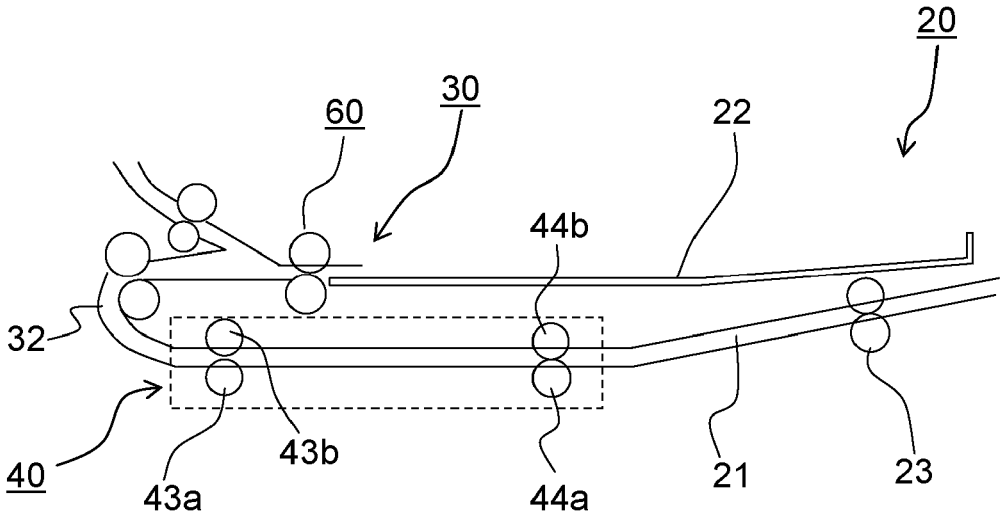

【FIG.3】
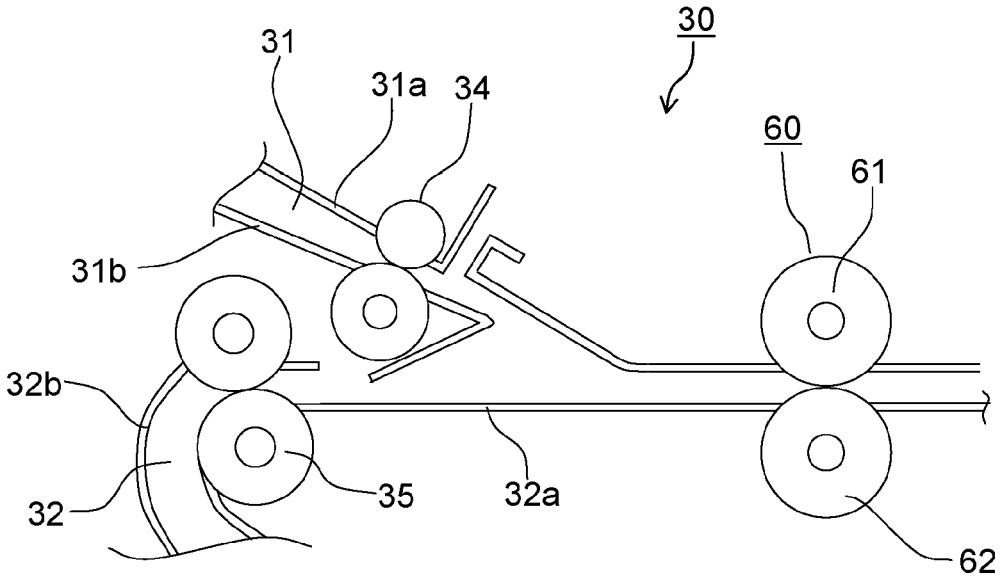

【FIG.4】
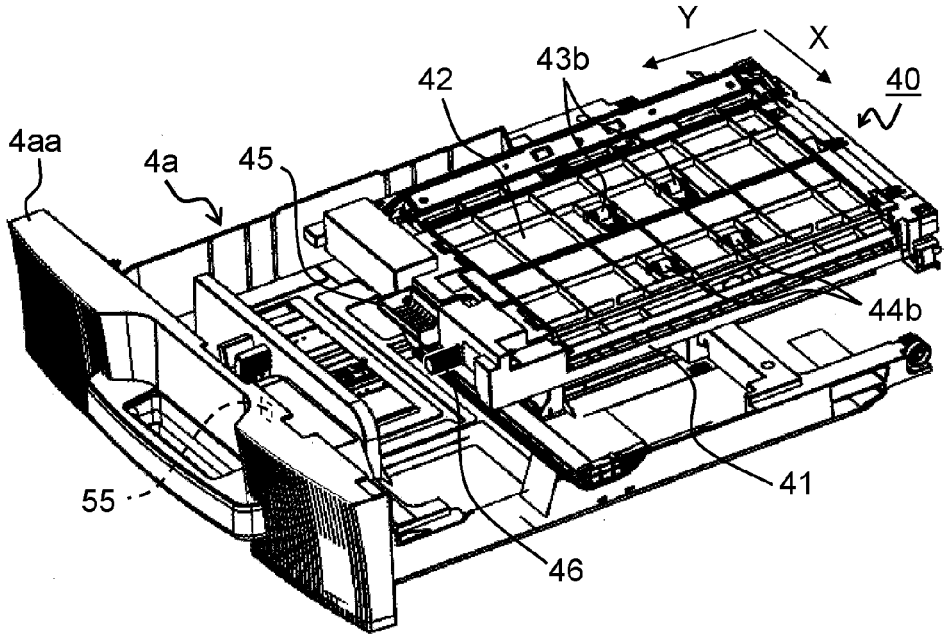

【FIG.5】
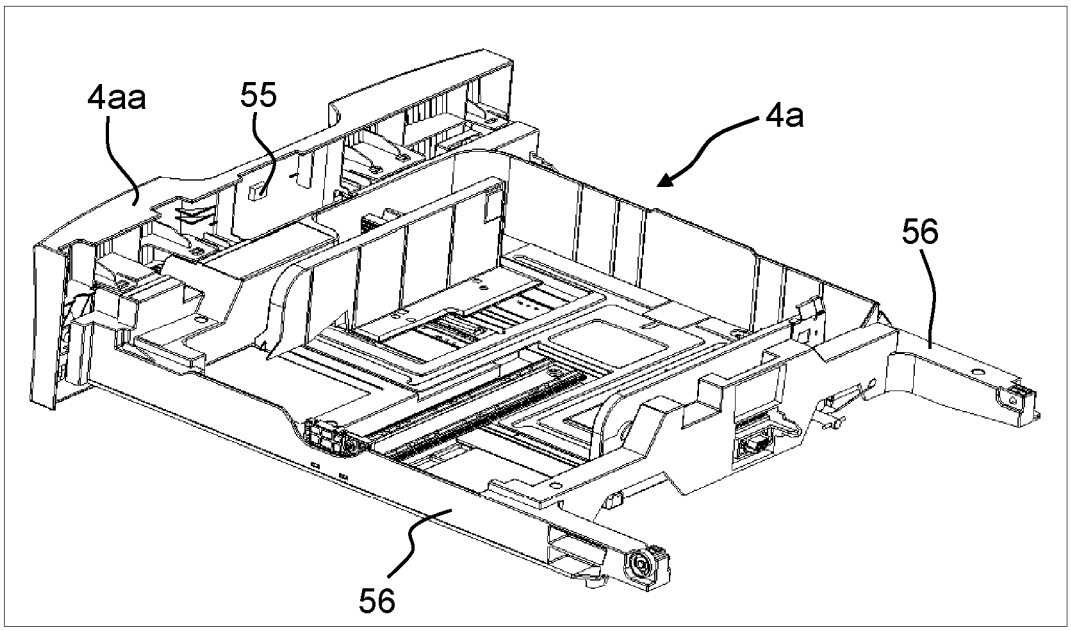

【FIG.6】
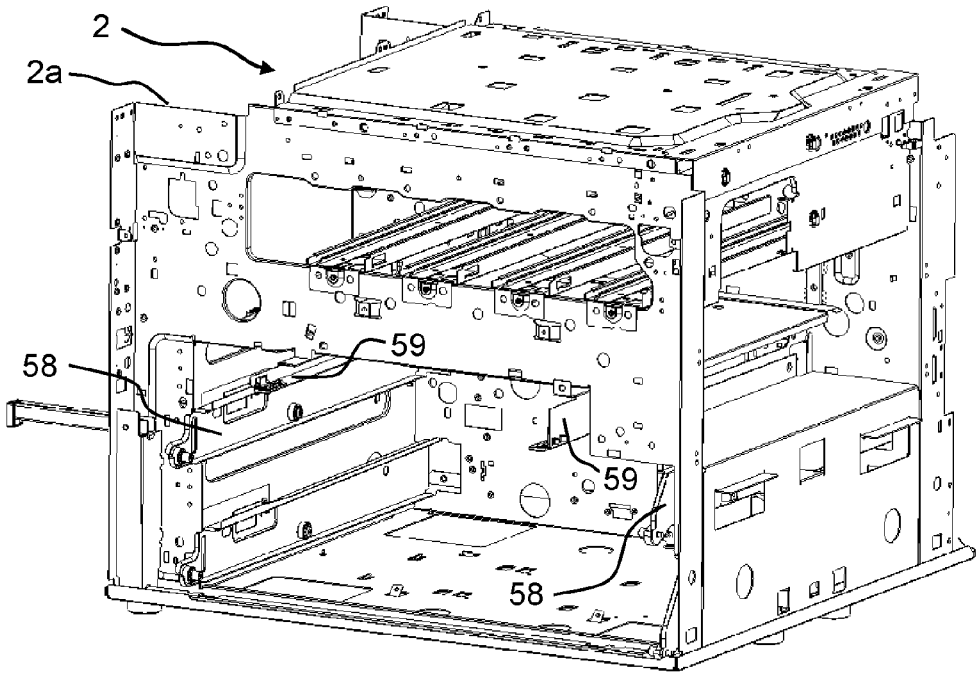

【FIG.7】
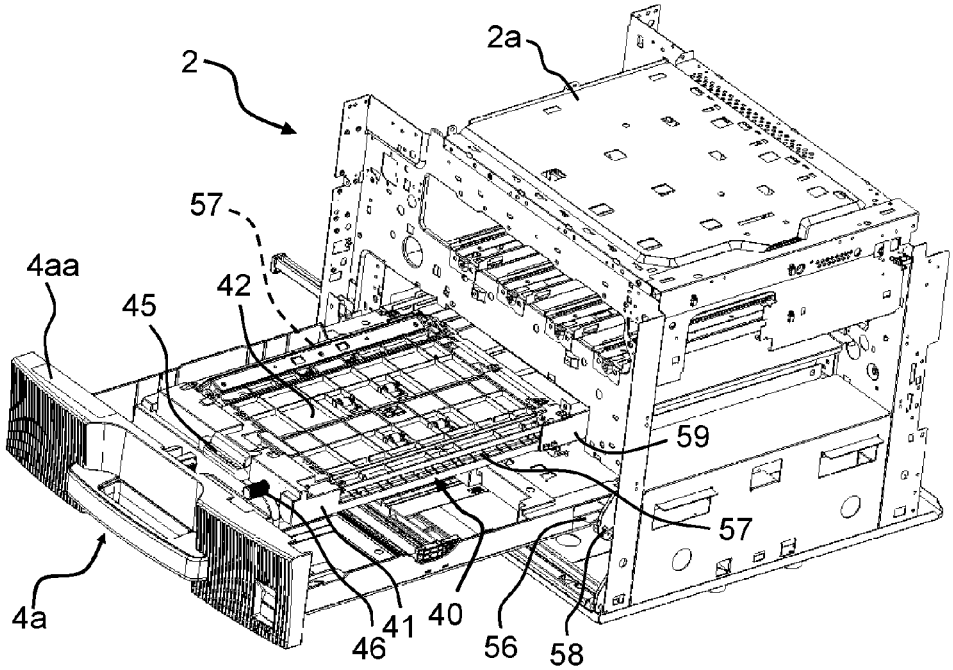

【FIG.8】
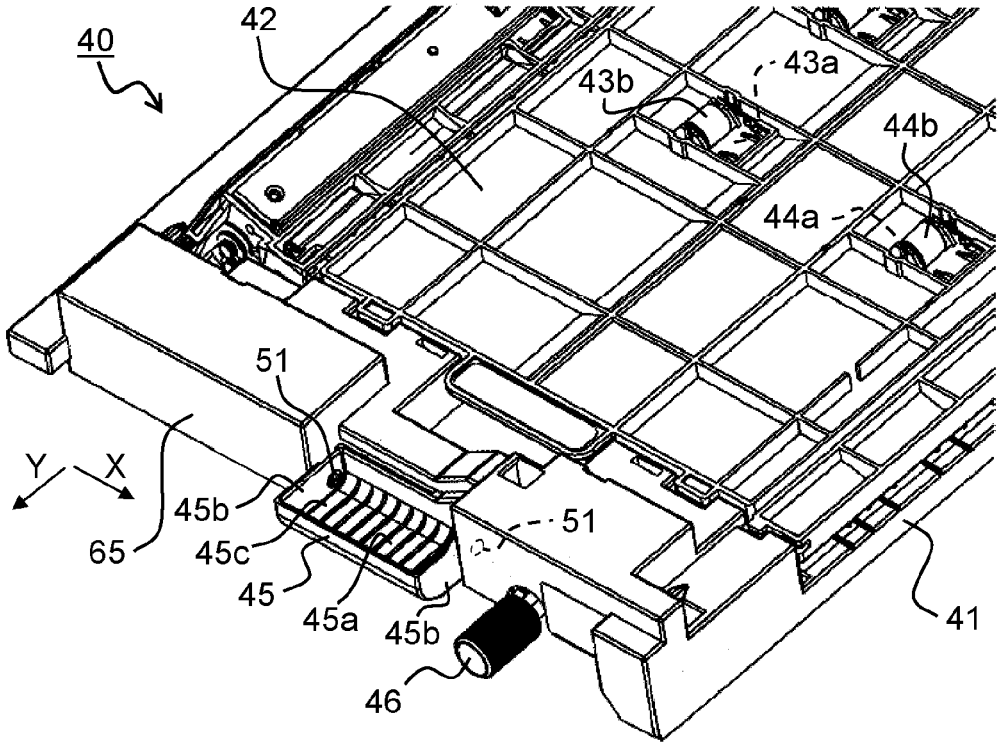

【FIG.9】
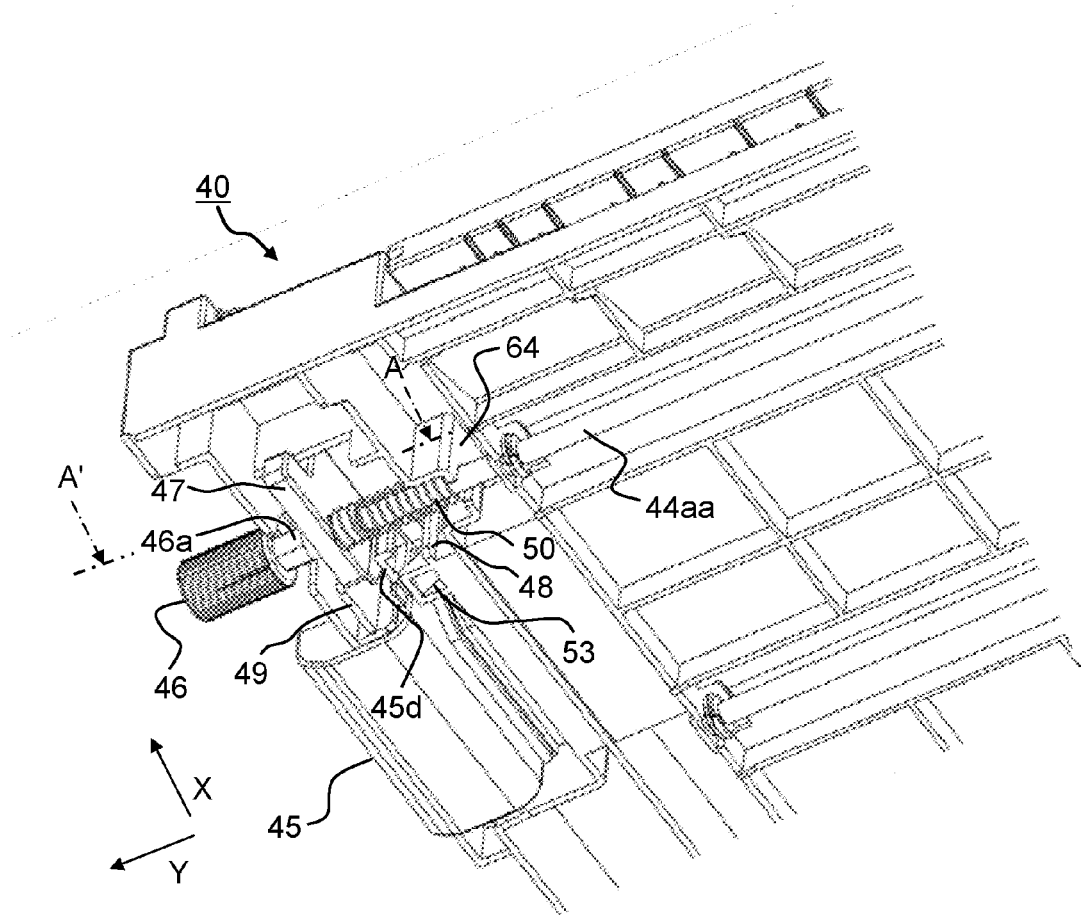

【FIG. 10】
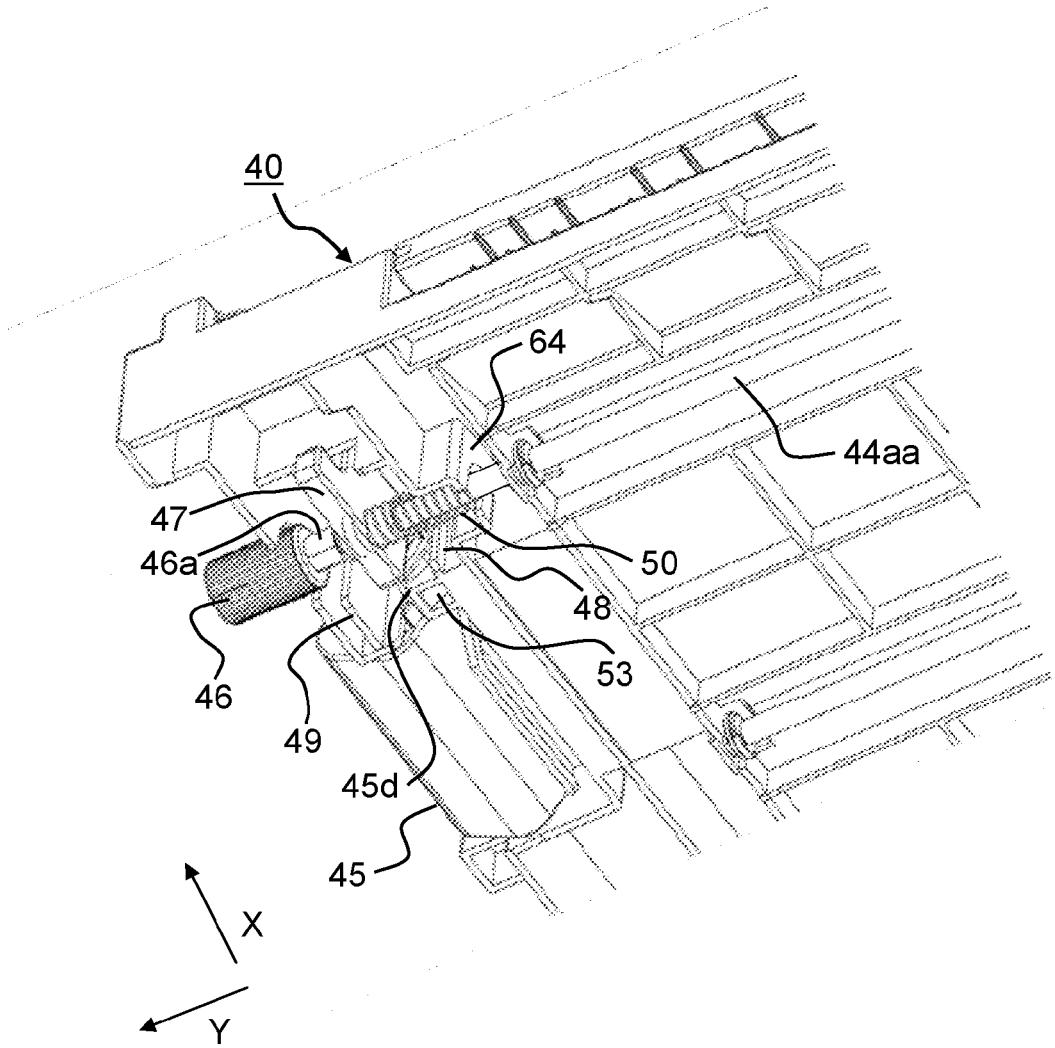

【FIG.11】
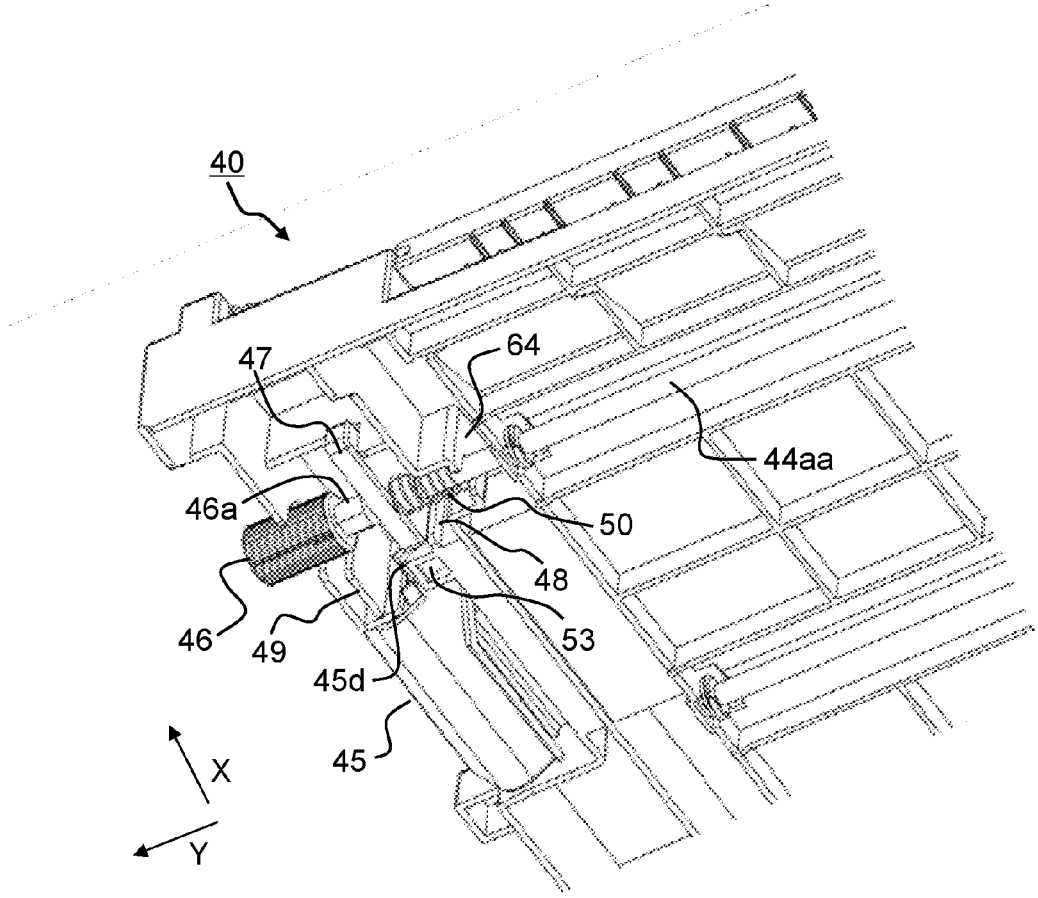

【FIG.12A】
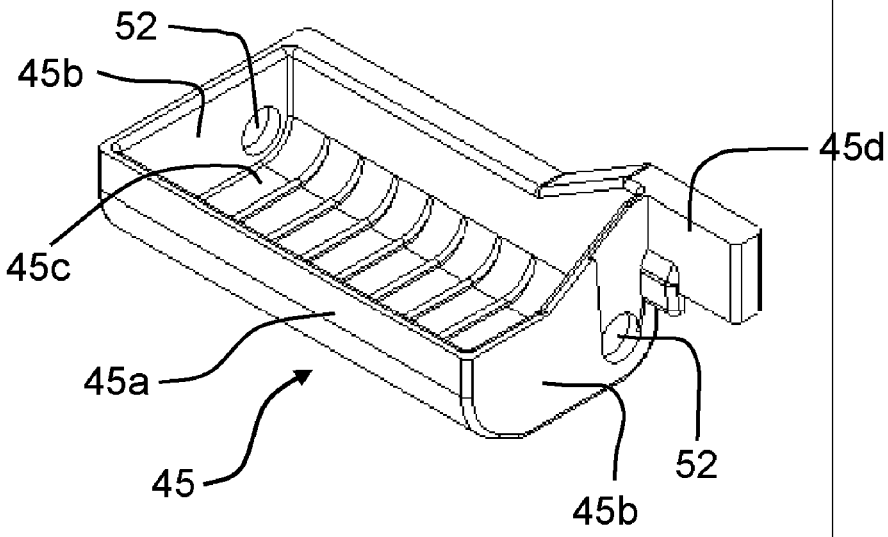
【FIG.12B】
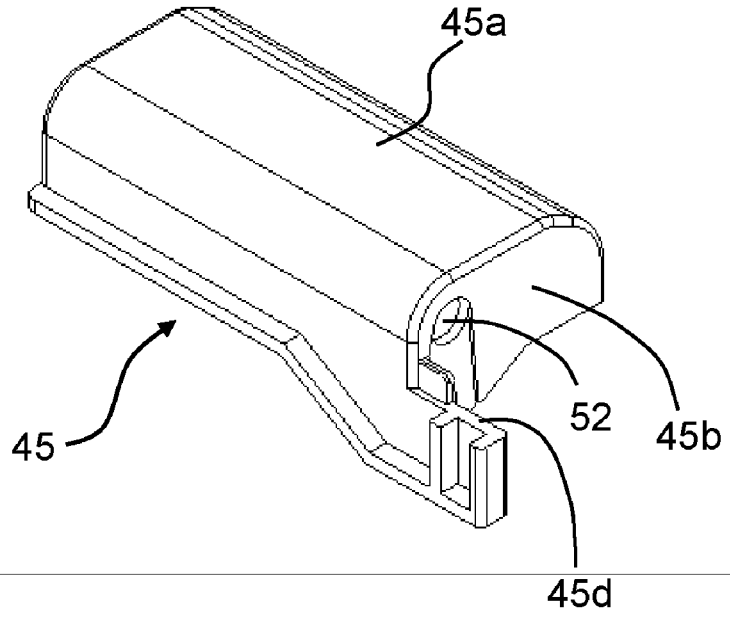

【FIG.13A】
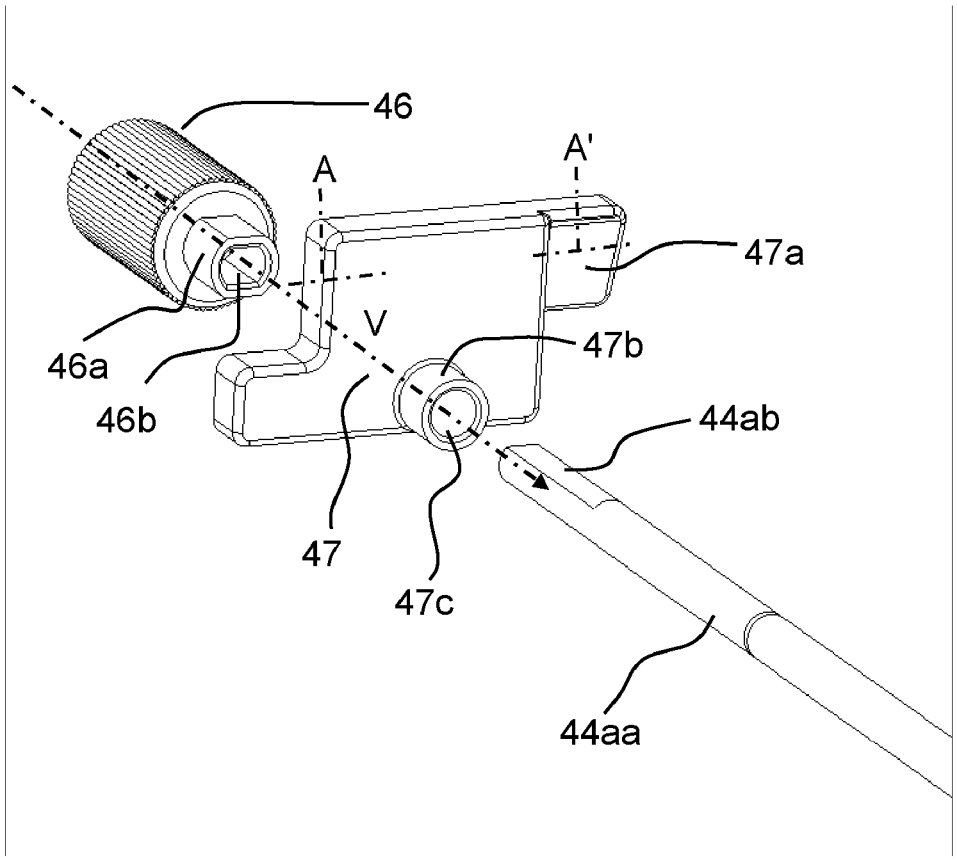
【FIG.13B】
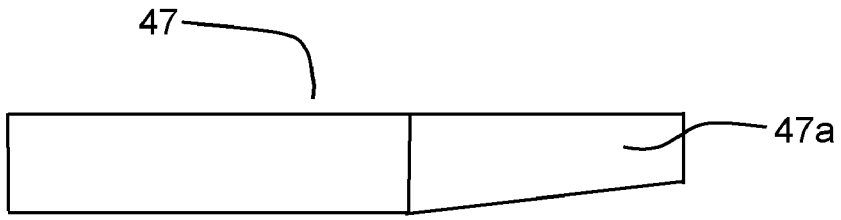

【FIG.14A】
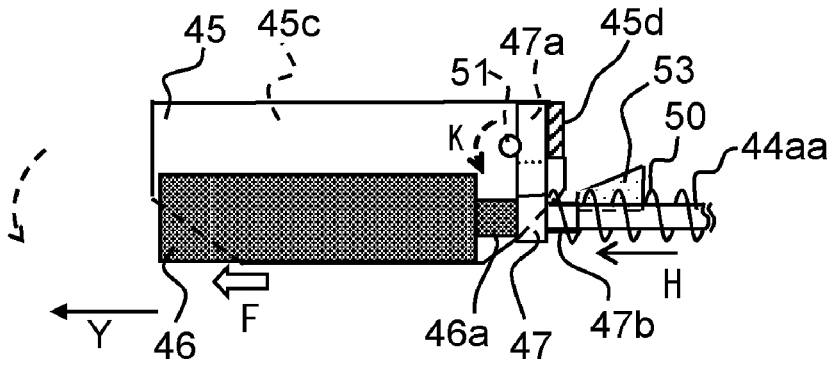
【FIG.14B】
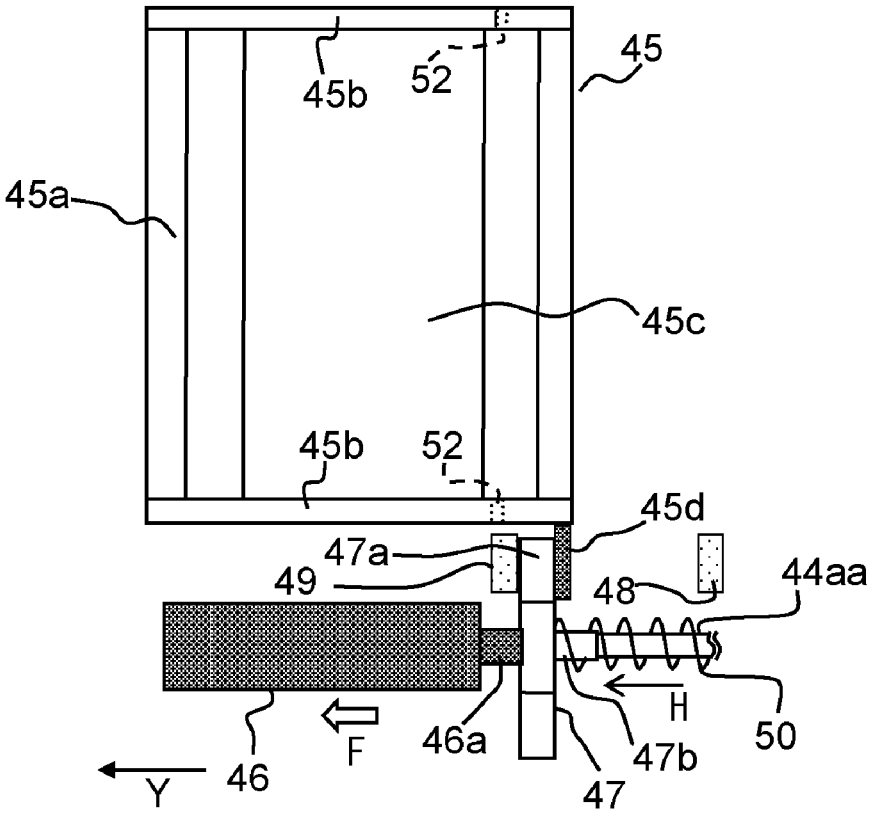

【FIG.15A】
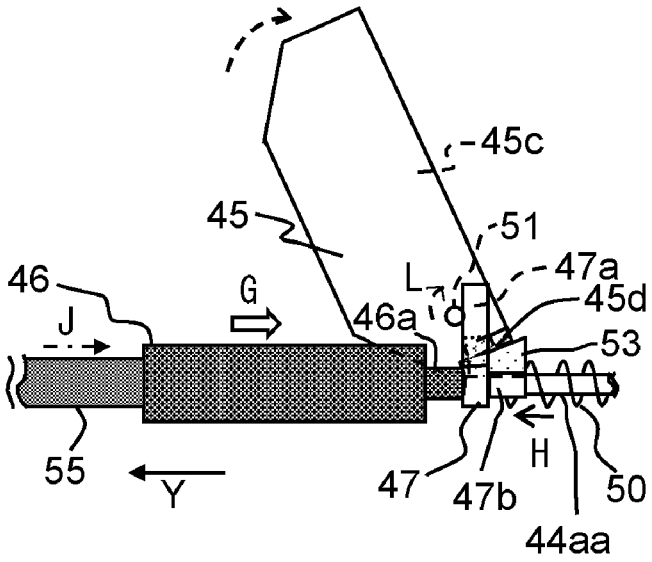
【FIG.15B】
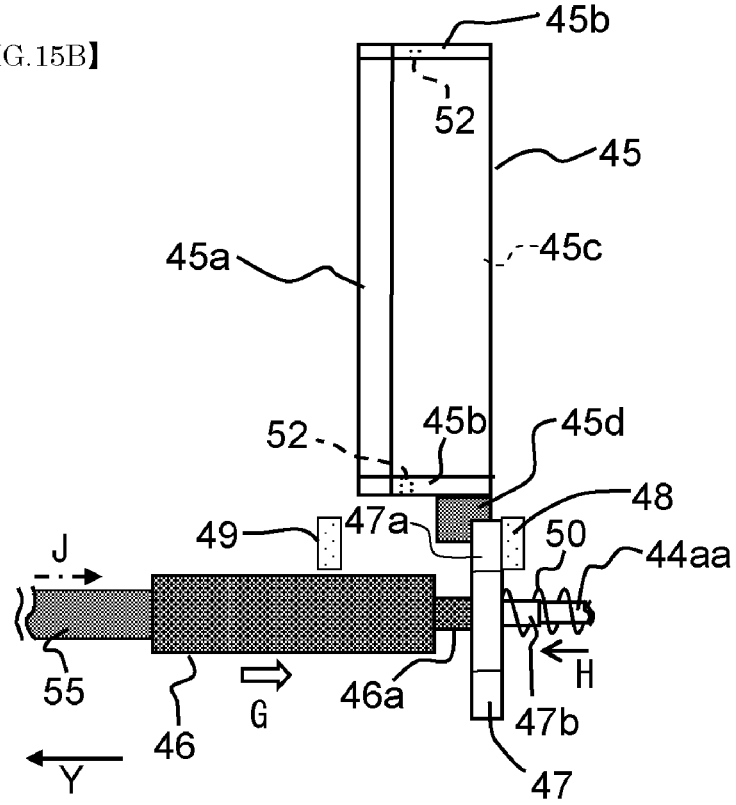

【FIG. 16】
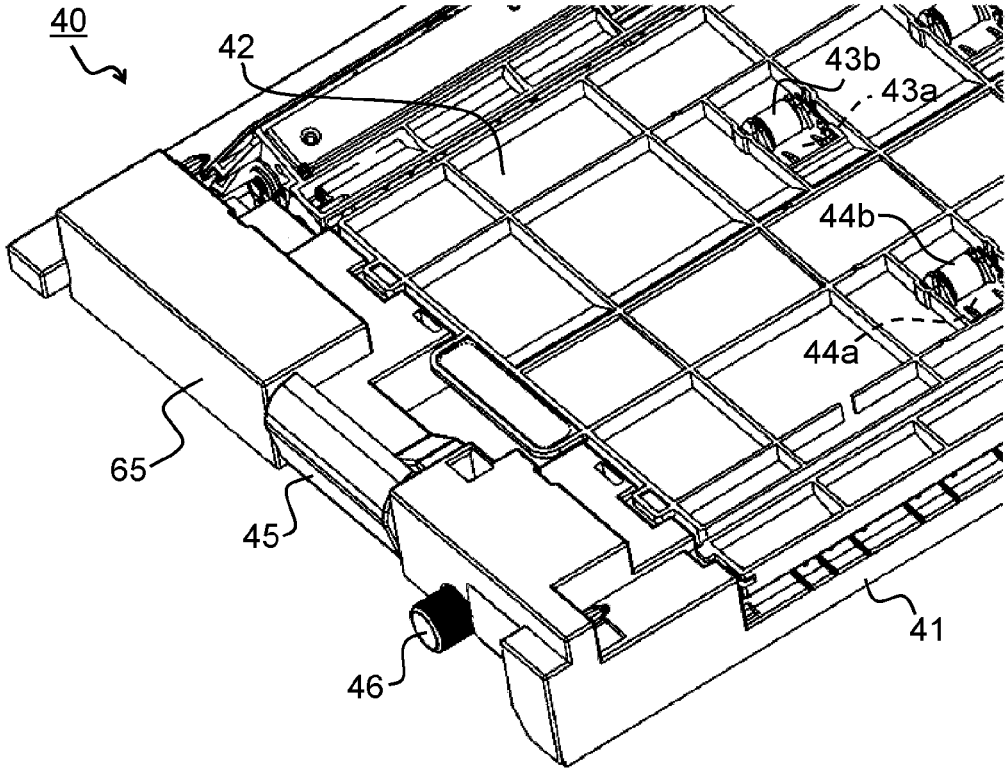

RECORDING MEDIUM CONVEYING DEVICE AND IMAGE FORMING APPARATUS

This application is based upon and claims priority to corresponding Japanese Patent Application Nos. 2008-152438, filed Jun. 11, 2008 and 2009-052874, filed Mar. 6, 2009, the entire contents of which are incorporated herein by reference.

BACKGROUND OF THE INVENTION

1. Field of the Invention

The present invention relates to a recording medium conveying device used in an image forming apparatus, such as a copying machine, a printer, or a facsimile machine (each of which makes use of, for example, an electrophotography method or an inkjet method), or a MFP (Multi-Functional Peripheral) comprising a combination thereof. In addition, the present invention relates to an image forming apparatus including the recording medium conveying device.

2. Description of the Background Art

Conventionally, in an image forming apparatus, a conveying unit provided for conveying a sheet (serving as an example of a recording medium) is used for easily removing a sheet jammed in the conveying unit. Such a conveying unit can be drawn out from the body of the image forming apparatus and mounted to the body of the image forming apparatus. Such a conveying unit can be drawn out from the body of the image forming apparatus perpendicularly to a sheet conveying direction. When a sheet is jammed in the conveying unit, a jam elimination operation is performed, in which the conveying unit is drawn out from the body to remove the jammed sheet.

A handle is provided at a draw-out side of the conveying unit. Therefore, when the conveying unit is drawn out from the body of the image forming apparatus for performing a jam elimination operation, an operator, such as a user or a person in charge of maintenance, can grasp the handle and easily draw out the conveying unit. The conveying unit is provided with a conveying roller. A knob is provided at the conveying-unit draw-out side of a rotating shaft of the conveying roller so that the operator can perform, for example, the jam elimination operation even if the operator does not draw out the conveying unit. The operator can rotate the conveying roller by rotating the knob with his/her hand. The operator can perform the jam elimination operation on the jammed sheet by taking out the jammed sheet from the conveying unit by rotating the conveying roller.

However, in such a conveying unit, since the handle and the knob are secured to the conveying unit, the handle and the knob project towards the draw-out side of the conveying unit. Therefore, an external shape of the conveying unit becomes large, as a result of which the conveying unit takes up a large area in a surrounding space. When the conveying unit is used in common in the bodies of a plurality of types of apparatuses, the bodies of the apparatuses need to be designed with reference to the size of the conveying unit. As a result, the shapes of the bodies of the apparatuses may become large.

To overcome this problem, the handle and the knob may be made removable. However, when the conveying unit is to be accommodated (i.e. put back in place or housed), the handle and the knob are removed from the conveying unit. Similarly, when the conveying unit is to be drawn out, the handle and the knob are mounted thereto. Therefore, it may not be possible to quickly perform, for example, a jam elimination operation. In addition, the mounting operation and the removing operation are troublesome to carry out. This may considerably reduce workability. And the operator may lose the handle and/or the knob.

A structure in which a sheet accommodating tray is disposed below a duplex unit, and in which sheet sending-out means is used in common by the duplex unit and the sheet holding tray is known. The duplex unit is provided for printing a second side (non-printing side) of a recording medium whose first side is printed. The sheet accommodating tray can be drawn out independently of the duplex unit in a direction perpendicular to a sheet-feeding direction of the recording medium. This structure makes it possible to reduce the size of and simplify the apparatus and to easily facilitate a jam elimination operation. In addition, it is possible to prevent parts from becoming damaged during the jam elimination operation and the recording medium from being left after the jam elimination operation.

However, in the above-described structure, although a jam elimination operation can be performed by drawing out, for example, the duplex unit, only a cutaway portion in which a finger is inserted is provided in, for example, the duplex unit. Therefore, the duplex unit, etc., may not be properly taken out. With regard to the above-described structure, a handle that projects from the duplex unit is not disclosed or even suggested. Similarly, there is no disclosure or suggestion of a knob for performing a jam elimination operation, etc., without taking out the duplex unit.

SUMMARY OF THE INVENTION

In view of the above-described problem, it is an object of the present invention to provide a recording medium conveying device which can be reduced in size and which can efficiently perform a jam elimination operation. It is also an object of the present invention to provide an image forming apparatus including such a recording medium conveying device.

According to an aspect of the present invention, there is provided a recording medium conveying device comprising a body portion capable of being mounted to and removed from a body of an apparatus in a direction perpendicular to a conveying direction of a recording medium, the body portion being provided with conveying rollers that conveys the recording medium; a knob member disposed at a side at which the body portion is removed, the knob member allowing manual rotation of the conveying roller; and a handle member for mounting the body portion to and removing the body portion from the body of the apparatus. In the recording medium conveying device, the handle member is rotatably supported so as to move between a first position and a second position, the first position being where the handle member is positioned when the recording medium conveying device is accommodated in the body of the apparatus, the second position being where the handle member projects from the body portion towards the side at which the body portion is removed. The knob member is connected to a rotating shaft of the conveying roller so as to move along a direction in which the body portion is removed. The handle member moves between the first position and the second position in response to an accommodation operation and a draw-out operation of the knob member.

BRIEF DESCRIPTION OF THE DRAWINGS

FIG. 1 is a schematic sectional view of the entire structure of an image forming apparatus according to an embodiment of the present invention;

FIG. 2 is a schematic sectional view of the structure of a duplex printing unit used in the embodiment;

FIG. 3 is a schematic sectional view of the vicinity of a pair of reverse rollers provided at a reverse unit;

FIG. 4 is a partial perspective view of the vicinity of a conveying unit and a feed cassette according to the embodiment, with a handle being open;

FIG. 5 is a perspective view of the feed cassette shown in FIG. 4 as seen obliquely from the rear;

FIG. 6 is a perspective view of a frame structural member of a housing of the image forming apparatus;

FIG. 7 is a perspective view showing a state in which the conveying unit and the feed cassette are drawn out from the frame structural member shown in FIG. 6;

FIG. 8 is a partial perspective view of the vicinity of a handle and a knob of the conveying unit shown in FIG. 4;

FIG. 9 shows the vicinity of the handle and the knob shown in FIG. 8 seen from below the conveying unit when the knob is in a state in which the knob is projected;

FIG. 10 shows the vicinity of the handle and the knob shown in FIG. 8 seen from below the conveying unit when the knob is in a state in which the knob is partly projected;

FIG. 11 shows the vicinity of the handle and the knob shown in FIG. 8 seen from below the conveying unit when the knob is in a state in which the knob is accommodated;

FIGS. 12A and 12B are each a perspective view of the handle. FIG. 12A is a top view of the handle. FIG. 12B shows the bottom side of the handle;

FIG. 13A is an exploded perspective view illustrating the vicinity of the knob and a shaft of a conveying roller and FIG. 13B is a sectional view taken along arrow AA' in FIG. 13A;

FIGS. 14A and 14B are each a schematic view showing a state in which the handle is open. FIG. 14A is a sectional view taken along arrow AA' in FIG. 9. FIG. 14B is a plan view as seen from the top side of FIG. 14A;

FIGS. 15A and 15B are each a schematic view showing a state in which the handle is accommodated. FIG. 15A is a sectional view taken along arrow AA' in FIG. 9. FIG. 15B is a plan view as seen from the top side of FIG. 15A; and FIG. 16 is a partial perspective view showing the vicinity of the conveying unit according to the embodiment, and a state in which the handle is accommodated.

DESCRIPTION OF THE PREFERRED EMBODIMENTS

An embodiment of the present invention is described with reference to the drawings. FIG. 1 is a side sectional view of the structure of an image forming apparatus (copying machine) serving as an apparatus body including a sheet conveying device according to a first embodiment of the present invention. FIG. 2 is a schematic sectional view of the structure of a duplex printing unit. FIG. 3 is a schematic sectional view of the vicinity of a pair of reverse rollers provided at a reverse unit.

As shown in FIG. 1, a feeding section 3 serving as a recording medium feeding section is disposed at a lower portion of a housing 2 of an image forming apparatus 1. Sheets P, which are exemplary recording media used for printing, are held in a stacked state at the feeding section 3. When printing is performed, the sheets P are separated one by one from the recording medium feeding section 3 and conveyed through a sheet conveying section 6 (described later) serving as a recoding medium conveying section. The feeding section 3 includes a first feed cassette 4*a* (sheet stacking section), a second feed cassette 4*b*, and a third feed cassette 4*c* in that order from the top. In addition to general sheets, the recording media may be, for example, postcards, envelopes, OHP (Overhead Projector) sheets, cloth, resin plates, metallic plates, or electronic substrates (green sheets).

To make it easier to replenish sheets, the first to third feed cassettes 4*a* to 4*c* can be independently drawn out perpendicularly in FIG. 1 from the housing 2 towards a user. In FIG. 1, a manual feeding section 5 is provided at an upper portion of the right lateral face of the housing 2. The manual feeding section 5 is used when images are formed on sheets that are different in type from the sheets P held in the first to third feed cassettes 4*a* to 4*c* (such as sheets having, for example, sizes or thicknesses that are different from those of the sheets P held in the first to third feed cassettes 4*a* to 4*c*) or when images are formed on sheets, such as OHP sheets, which cannot pass through a bent conveying path.

The sheet conveying section 6 for conveying the sheets P supplied from the feeding section 3 or the manual feeding section 5 to a transfer section 11 is provided in the housing 2. A pair of registration rollers 7 is disposed downstream from the sheet conveying section 6 in a sheet conveying direction and immediately upstream from the transfer section 11. The pair of registration rollers 7 corrects the orientation of the sheets P so that the conveying direction of the sheets P is perpendicular to the direction of a rotation axis of the registration rollers; and, then, stops the conveying of the sheets P once. Next, in synchronism with the formation of a toner image at an image forming section 10 (described later), the pair of registration rollers 7 sends the sheets P towards the transfer section 11.

An original reading section 8, which is one component of the image forming apparatus 1, is disposed on the upper side of the housing 2. The original reading section 8, primarily, includes an original stacking section 8*a*, an image reading section 8*b*, and an original discharging section 8*c*. Originals to be copied, having images (such as characters, drawings, patterns, etc.) thereon, are placed on the original stacking section 8*a*. When the originals are to be copied, the originals placed on the original stacking section 8*a* are separated one at a time, and are conveyed to the interior of the image reading section 8*b*. While the originals are conveyed into the image reading section 8*b*, image data of the originals are read by an image reading sensor (not shown). The originals whose image data have been read are discharged to the original discharging section 8*c* from the image reading section 8*b*.

The image forming section 10 and the transfer section 11 are provided downstream from the registration rollers 7 in the sheet conveying direction. An exposure section 9 is disposed at an upper portion of the housing 2 so as to be situated above the image forming section 10. The image forming section 10 primarily includes a photosensitive member 10*a*, a charging section 10*b*, a developing section 10*c*, and a cleaning section 10*d*. When an image is to be formed, the photosensitive member 10*a* rotates, and the surface of the photosensitive member 10*a* is uniformly charged by the charging section 10*b*. Then, the surface of the photosensitive member 10*a* is irradiated with laser light, corresponding to the image data of the original read by the original reading section 8, from the exposure section 9, to form an electrostatic latent image on the surface of the photosensitive member 10*a*. The electrostatic latent image formed on the surface of the photosensitive member 10*a* is developed by toner supplied from the developing section 10*c*. Then, at the transfer section 11, the toner image formed on the surface of the photosensitive member 10*a* is transferred to the sheet P conveyed in synchronism with the formation of the toner image by the registration rollers 7.

A fixing section 12 is provided downstream from the transfer section 11 in the sheet conveying direction. The sheet P to which the toner image has been transferred at the transfer section 11 is conveyed to the fixing section 12. The fixing section 12 includes a heating roller 12*a* and a pressing roller 12*b*. When the heating roller 12*a* and pressing roller 12*b* heat, press, and convey the sheet P, the toner image is fused and fixed to the sheet P. A discharge/branching section 13 is provided downstream from the fixing section 12. When duplex printing is not performed, the sheet P discharged from the fixing section 12 is discharged to a sheet receiving tray 14, serving as a recording medium discharging section, provided on the left lateral face of the housing 2, from the discharge/branching section 13.

A duplex printing unit 20 is disposed above the feeding section 3 and below a portion extending from the image forming section 10 to the discharge/branching section 13. As shown in FIG. 2, the duplex printing unit 20 includes a reverse conveying path 21, an intermediate tray 22, and a reverse unit 30, among other things. The reverse conveying path 21 is provided for conveying a sheet conveyed to the duplex printing unit 20 to the sheet conveying section 6. The intermediate tray 22 temporarily stacks the sheet that is reversed. The reverse unit 30 includes reverse rollers 60 that reverse the sheet conveying direction.

As shown in FIG. 3, the reverse unit 30 is provided with an entrance conveying path 31 and a discharge conveying path 32, among other things. The entrance conveying path 31 is a sheet conveying path for sending the sheet P onto the intermediate tray 22. The discharge conveying path 32 is a sheet conveying path for discharging the sheet P from the intermediate tray 22.

The entrance conveying path 31 is provided for guiding the sheet P to the duplex printing unit 20 from the discharge/branching section 13 (see FIG. 1). The entrance conveying path 31 is provided with an upper guide 31*a*, a lower guide 31*b*, and a pair of conveying rollers 34. The sheet P that is conveyed towards the duplex printing unit 20 from the discharge/branching section 13 passes through a sheet conveying space provided between the upper guide 31*a* and the lower guide 31*b*, and is conveyed to the pair of reverse rollers 60 by the pair of conveying rollers 34.

The discharge conveying path 32 is branched from the entrance conveying path 31 at the downstream side of the pair of conveying rollers 34 in the entrance conveying path 31, and extends towards the left in FIG. 3. As shown in FIG. 2, the discharge conveying path 32 extends downward, and the reverse conveying path 21 communicates with the downstream side of the discharge conveying path 32. The discharge conveying path 32 is provided with a plurality of guide members (including a lower guide 32*a* and an upper guide 32*b*, etc.), and a pair of conveying rollers 35. A conveying unit (recording medium conveying device) 40 that conveys a sheet is disposed at the reverse conveying path 21. The conveying unit 40 is provided with first conveying rollers 43*a* and driven rollers 43*b* thereof, and second conveying rollers (conveying rollers) 44*a* and driven rollers 44*b* thereof, etc. The conveying unit 40 will be described in more detail later.

The pair of reverse rollers 60 is provided downstream in the sheet conveying direction of a portion where the discharge conveying path 32 is branched from the entrance conveying path 31 (that is, on the right side in FIG. 3). The intermediate tray 22, serving as a temporary stacking portion that stacks once a sheet P having one side printed, is provided downstream of the pair of reverse rollers 60 (see FIG. 2). After the pair of reverse rollers 60 stacks the sheet P on the intermediate tray 22 once, the pair of reverse rollers 60 reverses the direction of rotation thereof to switch the sheet conveying direction. That is, the sheet conveying direction is reversed by the pair of reverse rollers 60.

The pair of reverse rollers 60 comprises a reverse roller 61 and a driven roller 62. The driven roller 62 press-contacts the reverse roller 61 from below to form a nip portion where a sheet P is inserted between the driven roller 62 and the reverse roller 61. The reverse roller 61 is rotated by a motor (not shown) By switching the direction of rotation of the reverse roller 61 to a clockwise direction or to a counterclockwise direction in FIG. 3, the pair of reverse rollers 60 switches the conveying direction of the sheet P.

When duplex printing is performed, the sheet P discharged from the fixing section 12 is conveyed to the duplex printing unit 20 through the discharge/branching section 13. The sheet P conveyed to the duplex printing unit 20 is conveyed to the intermediate tray 22 once by the reverse unit 30 of the duplex printing unit 20. Next, after the conveying direction of sheet P is reversed, and the sheet P is re-conveyed to the sheet conveying section 6 through the reverse path 21. Then, the sheet P is conveyed to the transfer section 11 by the pair of registration rollers 7.

FIG. 4 is a partial perspective view of the vicinity of the conveying unit 40 and the feed cassette 4*a* according to the embodiment. In addition, FIG. 4 shows a state in which a handle 45 (described below) is open. FIG. 5 is a perspective view of the feed cassette shown in FIG. 4 as seen obliquely from the rear. FIG. 6 is a perspective view of a frame structural member of the housing of the image forming apparatus. FIG. 7 is a perspective view showing a state in which the conveying unit and the feed cassette are drawn out from the frame structural member shown in FIG. 6. In FIGS. 4 to 7, components common to those shown in FIGS. 1 to 3 are given the same reference numerals, and will not be described below.

As shown in FIG. 4, the conveying unit 40 is mounted at the upper space of the inside of the first feed cassette 4*a*, and conveys a sheet in the direction of arrow X as shown in FIG. 4 (in the sheet conveying direction). The conveying unit 40 can be removable from the housing 2 in a Y direction that is perpendicular to the X direction, and mountable to the housing 2 in a direction opposite to the Y direction. Here, the Y direction is perpendicular to the conveying direction of a sheet serving as a recording medium. The handle 45, used for taking out the conveying unit 40, and a knob 46, used for manually performing a jam elimination operation, are provided at a removal-side end (downstream-side end in the Y direction) of the conveying unit 40.

In addition, the first feed cassette 4*a* can be removed from the housing 2 in the Y direction, and mounted to the housing 2 in a direction opposite the Y direction. Once the first feed cassette 4*a* is drawn out from the housing 2, the conveying unit 40 can be drawn out from the housing 2 and then mounted to the housing 2. Once the conveying unit 40 is mounted to the housing 2, the first feed cassette 4*a* can again be mounted to the housing 2. A pushing portion 55 (see FIG. 5) for pushing the knob (knob member) 46, provided at the conveying unit 40, is provided at a removal-side end portion 4*aa* of the first feed cassette 4*a*. The pushing portion 55 is provided so as to protrude inward of the removal-side end portion 4*aa* of the first feed cassette 4*a*. The pushing portion 55 is provided at a location where the pushing portion 55 can push the knob 46 when the first feed cassette 4*a* is mounted to the housing 2, and has a size that allows the pushing portion 55 to push the knob 46. More specifically, the pushing portion 55 is formed of hard rubber and has a height of approximately 1 cm and its sides have a length of approximately 2-cm.

As shown in FIG. 4, the conveying unit 40 primarily comprises a unit body (body portion) 41 and an opening/closing cover 42, which covers the upper surface of the unit body 41. The unit body 41 is primarily provided with the first conveying rollers 43*a*, the second conveying rollers 44*a*, the handle (handle member) 45, and the knob 46. The opening/closing cover 42 is provided with the driven rollers 43*b* and the driven rollers 44*b* opposing the first conveying rollers 43*a* and the second conveying rollers 44*a*, respectively. The first conveying rollers 43*a* and the second conveying rollers 44*a* are disposed in that order from the upstream side in the sheet conveying direction. The first conveying rollers 43*a* and the second conveying rollers 44*a* are connected to a drive motor (not shown) provided at the body of the apparatus (the image forming apparatus 1; see FIG. 1), and are rotated by rotating the drive motor.

As shown in FIG. 6, a frame structural member 2*a* of the housing 2 is provided with a pair of guide rails 58 and a pair of guide rails 59. The guide rails 58 support the first feed cassette 4*a* when the first feed cassette 4*a* is mounted to the housing 2 or removed from the housing 2. The guide rails 59 support the conveying unit 40 when the conveying unit 40 is mounted to the housing 2 or removed from the housing 2. As shown in FIGS. 5 and 7, a pair of rail members 56, provided at the first feed cassette 4*a*, engages the pair of guide rails 58. The pair of rail members 56 can slide with respect to the pair of guide rails 58. Therefore, as shown in FIG. 7, the first feed cassette 4*a* can be drawn out from the housing 2, and the drawn out first feed cassette 4*a* can be mounted to the housing 2. As shown in FIG. 7, a pair of rail members 57, provided at the conveying unit 40, engages the pair of guide rails 59. The pair of rail members 57 can slide with respect to the pair of guide rails 59. Therefore, as shown in FIG. 7, the conveying unit 40 can be drawn out from the housing 2 and the drawn out conveying unit 40 can be mounted to the housing 2.

FIG. 8 shows the vicinity of the handle 45 and the knob 46 (both of which are shown in FIG. 4). FIG. 9 shows the vicinity of the handle and the knob shown in FIG. 8 seen from below the conveying unit when the knob is in a state in which the knob is projected. FIG. 10 shows the vicinity of the handle and the knob shown in FIG. 8 seen from below the conveying unit when the knob is in a state in which the knob is partly accommodated. FIG. 11 shows the vicinity of the handle and the knob shown in FIG. 8 seen from below the conveying unit when the knob in a state in which the knob is accommodated. FIGS. 12A and 12B show the handle after being taken out from the conveying unit. FIG. 12A is a top view of the handle. FIG. 12B shows the bottom side of the handle. FIG. 13A is an exploded perspective view illustrating the vicinity of the knob and a shaft of a conveying roller. FIG. 13B is a sectional view of a handle moving member taken along arrow AA'. FIGS. 14A and 14B are each a schematic view showing a state in which the handle is open. FIG. 14A is a sectional view taken along arrow AA' in FIG. 9. FIG. 14B is a plan view as seen from the top side of FIG. 14A. FIGS. 15A and 15B are each a schematic view showing a state in which the handle is accommodated. FIG. 15A is a sectional view taken along arrow AA' in FIG. 9. FIG. 15B is a plan view as seen from the top side of FIG. 15A. FIG. 16 is a partial perspective view showing the vicinity of the conveying unit according to the embodiment in a state in which the handle is accommodated. In FIGS. 8 to 16, components common to those shown in FIGS. 1 to 7 are given the same reference numerals, and will not be described below.

As shown in FIG. 8, a rotating shaft 51 rotatably supports the handle 45 at an outer wall surface at the removal side of the unit body 41. The handle 45 comprises a rear plate 45*a*, and two side plates 45*b*. The rear plate 45*a* is formed of a plate whose cross section in a direction at right angles to the sheet conveying direction is substantially U shaped. The side plates 45*b* comprise flat plates for closing openings at both ends of the rear plate 45*a* in the sheet conveying direction. An opening 45*c* is formed by the rear plate 45*a* and the pair of side plates 45*b*.

When, as shown in FIG. 16, the handle accommodated in the conveying unit 40 (the opening 45*c* generally faces a front plate 65 of the unit body 41) is rotated downward around the rotating shaft 51 as center, the opening 45*c* is open upward (see FIG. 8). When the handle 45 is rotated upward from the state shown in FIG. 8, the opening 45*c* generally faces the front plate 65 (see FIG. 16).

As shown in FIG. 12 (which is a figure showing the handle 45 after being taken out from the conveying unit 40), the handle 45 has openings 52 for inserting the rotating shaft 51 therein. As shown in FIG. 9, the handle 45 is provided with a contact portion 45*d* at an end of the rear plate 45*a* on the right side of the side-plate in FIG. 12 so as to project towards the knob 46. As the handle 45 moves to a substantially vertical state (closed state, a first position) from a substantially horizontal state (open state, a second position) as will be described later, a handle moving member 47 is always in contact with the contact portion 45*d*.

As shown in FIG. 15A, when the handle 45 is moved upward and set in an upright position (closed state), because the lower surface of the contact portion 45*d* of the handle 45 contacts a handle movement restricting portion 53, provided at the unit body 41, the movement of the handle 45 is restricted. As shown in FIGS. 14A and 15A, the upper surface of the handle movement restricting portion 53 (that is, the surface that contacts the bottom surface of the contact portion 45*d* of the handle 45) is an inclined surface so as to make it easier to hold the contact portion 45*d*. At this time, the handle moving member 47 (described later) is in contact with the upper surface of the contact portion 45*d*. The handle 45 is accommodated in the unit body 41 (first position). Therefore, the handle 45 can be opened and closed (that is, moved) from the open position (at which the handle 45 is set in a substantially horizontal state) to the closed position (at which the handle 45 is set in an upright state). Since the center of gravity of the handle 45 is positioned at the rear plate 45*a*, if there is no load, the handle 45 rotates downward around the rotating shaft 51 (as indicated by a dotted arrow K in FIG. 14A) due to its own weight to be set in an open state. That is, it is possible for an operator to grasp the handle 45 and draw out the conveying unit 40 from the housing 2.

As shown in FIGS. 8 to 11, the knob 46 is provided on the right of the handle 45. The knob 46 has a circular cylindrical shape. As shown in FIGS. 9 to 11, a supporting portion 46*a* having circular cylindrical shape and a diameter that is smaller than that of the knob 46 is provided at an inner end surface of the knob 46. The supporting portion 46*a* is fitted and connected to a rotating shaft 44*aa* of the second conveying rollers 44*a* so as to be movable along the draw-out direction (Y direction). And, the rotating shaft 44*aa* can also rotate when the knob 46 is rotated. By manually rotating the knob 46, for example, a jam elimination operation can be performed.

The handle moving member 47, formed of a plate member, is provided adjacent to the supporting portion 46*a* of the knob 46. At a position where the supporting portion 46*a* of the knob 46 contacts the handle moving member 47, the handle moving member 47 is fitted to the rotating shaft 44*aa* of the second conveying rollers 44*a*. The handle moving member 47 has an inclined portion 47*a* (see FIG. 13B) that allows it to easily push the contact portion 45*d*. This inclined portion is located on the upper portion of the handle moving member 47, on the side to which the handle member 45 is accommodated.

Here, with reference to FIG. 13A, the method of mounting the knob 46 and the handle moving member 47 to the rotating shaft 44*aa* of the second conveying rollers 44*a* will be described. A D-cut portion 44*ab* is provided at an end of the rotating shaft 44*aa* to which the knob 46 is mounted. First, the rotating shaft 44*aa* is inserted into a knob return spring 50 (described later; shown in FIG. 9) starting from its D-cut portion 44*ab*. Next, the rotating shaft 44*aa* is inserted into a cylindrical through-hole 47*c* of the supporting portion 47*b* of the handle moving member 47, to mount the handle moving member 47 to the rotating shaft 44*aa*. Further, the rotating shaft 44*aa* is inserted into a through-hole 46*b* of the supporting portion 46*a* of the knob 46, to mount the knob 46 to the rotating shaft 44*aa*. Here, the inside diameter of the through-hole 47*c* is large enough to allow smooth movement of the handle moving member 47 along the rotating shaft 44*a* without any rattling. The shape of the through-hole 46*b* is a D-cut shape similar to the shape of the D-cut portion 44*ab* of the rotating shaft 44*aa*. The inside diameter of the through hole 46*b* is also large enough to allow smooth movement of the knob 46 along the rotating shaft 44*a* without any rattling. Here, a threaded hole (not shown) is provided at an end of the D-cut portion 44*ab* of the rotating shaft 44*aa*. A closing portion (not illustrated) having an opening where a screw shaft passes therethrough is provided at the knob-46 side of the supporting portion 46*a* of the knob 46. A screw having a shaft half of whose length can be inserted into the threaded hole at the end of the D-cut portion 47*ab* is used. That is, the knob 46 can be moved over half the entire length of the screw. The screw is inserted into the D-cut portion 44*ab* of the rotating shaft 44*aa* along an alternate long and short dash line V shown in FIG. 13. When the knob 46 is moved in a direction opposite to the direction in which the screw is inserted in FIG. 13, the closing portion at the supporting portion 46*a* contacts the head of the screw, so that the movement of the knob 46 is restricted. Therefore, the knob 46 does not fall from the rotating shaft 44*aa*.

Next, as shown in FIG. 15, when the knob 46 moves towards the accommodation side at which the knob 46 is accommodated in the unit body 41, that is, when the knob 46 moves in a direction opposite to the Y direction, the handle moving member 47 contacts a first movement restricting portion 48 projecting from the unit body 41. The first movement restricting portion 48 restricts the movement of the handle moving member 47 towards the accommodation-side of the knob 46 beyond the first movement restricting portion 48. On the other hand, when the knob 46 moves towards the draw-out side (Y direction) where the knob 46 is drawn out from the unit body 41, the handle moving member 47 contacts a second movement restricting member 49 projecting from the unit body 41. The second movement restricting member 49 restricts the movement of the handle moving member 47 towards the draw-out side of the knob 46 beyond the second movement restricting member 49.

Accordingly, the knob 46 can move through a distance from the first movement restricting portion 48 to the second movement restricting portion 49. When the handle moving member 47 contacts the second movement restricting portion 49, the handle moving member 47 is positioned closer than the contact portion 45*d* to the draw-out side (Y-direction side) (see FIG. 14B). When the handle moving member 47 contacts the first movement restricting portion 48, the handle moving member 47 pushes the contact portion 45*d* of the handle 45 towards the accommodation side (see FIG. 15B). The handle moving member 47 is biased towards the draw-out side of the conveying unit 40 (in the direction of solid arrows H in FIGS. 14 and 15) by the knob return spring 50 formed of a coil spring and serving as a biasing member (biasing means) wound around the rotating shaft 44*aa* of the second conveying rollers 44*a*. The knob return spring 50 wound around the rotating shaft 44*aa* is inserted between the handle moving member 47 and a spring holding wall 64 provided at the unit body 41 (see FIGS. 9 to 11).

When the first feed cassette 4*a* is not mounted to the housing 2, the knob 46 is not pushed by the pushing portion 55 (compare FIG. 14 with FIGS. 5 and 15). Therefore, the handle moving member 47 is biased by the knob return spring 50, and moves until the handle moving member 47 contacts the second movement restricting portion 49 (as indicated by a white arrow F in FIG. 14). As the handle moving member 47 moves, the knob 46 also moves, and projects towards the draw-out side of the conveying unit 40 from the unit body 41 (see FIGS. 4, 8). Therefore, an operator can easily manually rotate the knob 46 so as to easily perform jam elimination operations, etc.

While the handle 45 is positioned at the first position where the handle 45 is accommodated in the unit body 41, when the first feed cassette 4*a* is drawn out from the housing 2 and the pushing portion 55 no longer pushes the knob 46, the handle moving member 47 is biased by the knob return spring 50, so that the handle moving member 47 is moved until the handle moving member 47 contacts the second movement restricting portion 49. At this time, since the handle moving member 47 is no longer pushing the contact portion 45*d* of the handle 45, the handle 45 rotates around the rotating shaft 51 due to gravitational force. Then, the contact portion 45*d* of the handle 45 contacts the handle moving member 47 that has stopped by coming into contact with the second movement restricting portion 49 again. More specifically, the handle moving member 47 is sandwiched between the contact portion 45*d* and the second movement restricting portion 49 (see FIG. 14B). Therefore, an operator such as a user can grasp the handle 45 easily. As a result, the operator can easily draw out the conveying unit 40 from the housing 2, allowing him to perform a jam elimination operation that could not be performed by only manually turning the knob 46.

Once the conveying unit 40 is mounted to the interior of the apparatus housing 2 and the first feed cassette 4*a* is mounted to the housing 2, as shown in FIG. 15, the pushing portion 55 pushes the knob 46 towards the accommodation side (right side in FIG. 15), which moves (in the direction of a dotted arrow J in FIG. 15) with the movement of the first feed cassette 4*a*. Then, the knob 46 is moved towards the accommodation side (as indicated by a white arrow G in FIG. 15) against the biasing force (whose direction is indicated by a solid arrow H) of the knob return spring 50 until the handle moving member 47 comes into contact with the first movement restricting portion 48. Therefore, the knob 46 is accommodated in the unit body 41 as shown in FIG. 16.

By accommodating the knob 46 in the unit body 41 as mentioned above, the handle moving member 47 pushes the contact portion 45*d* of the handle 45 towards the accommodation side as shown in FIG. 15. When the contact portion 45*d* is pushed by the handle moving member 47, the handle 45 moves upward around the rotating shaft 51 as center (as indicated by a dotted arrow L in FIG. 15A). Therefore, the handle 45 is accommodated in the body portion 41 of the conveying unit 40 as shown in FIG. 16. The handle 45 does not need to be completely accommodated in the body portion 41 of the conveying unit 40. That is, the handle 45 is formed and disposed so that a projection area of the handle 45 towards the bottom surface of the image forming apparatus 1 when the handle 45 is closed at the first position is smaller than a projection area of the handle 45 towards the bottom surface of the image forming apparatus 1 when the handle 45 is open at the second position.

By virtue of the above-described structure, the handle 45 can be assistedly opened when the knob 46 is not accommodated in the conveying unit 40, and can be assistedly closed when the knob 46 is accommodated in the conveying unit 40. Accordingly, the handle 45 can be either accommodated in the conveying unit 40 (when in the closed, accommodated state) or grasped (when in the open, drawn-out state), due to the knob 46 being accommodated in and/or drawn out from the conveying unit 40, thereby causing the handle 45 to rotate.

Therefore, in case an operation related the conveying unit 40, such as a jam elimination operation, needs to be performed, when the first feed cassette 4*a* is drawn out in the Y direction shown in FIG. 4, the knob 4 and the handle 45 can be assistedly projected towards the draw-out side of the conveying unit 40. On the other hand, during operation of the body of the apparatus, the knob 46 and the handle 45 can be assistedly accommodated in the conveying unit 40 by accommodating the first feed cassette 4*a* in the housing 2 as a result of moving the first feed cassette 4*a* in a direction opposite to the Y direction shown in FIG. 4. Therefore, the conveying unit 40 can be reduced in size, providing greater freedom when designing the other structural members. Consequently, the housing 2 of the image forming apparatus 1 can be reduced in size. For example, as shown in FIG. 4, a central portion in the sheet conveying direction of the end portion 4*aa* of the first feed cassette 4*a* can be formed so as to project towards the conveying unit 40.

Even if the conveying unit 40 is used with more than one apparatus body, the freedom in designing the body of each apparatus can be increased. Since the handle 45 and the knob 46 can be accommodated without removing them, for example, a jam elimination operation can be quickly performed when necessary. In addition, since one does not need to, for example, bother with mounting and removing the handle 45 and the knob 46 or worry about losing the handle 45 and the knob 46, the device is a user-friendly device, thus increasing operability.

In summary, the handle moving member 47 that pushes the contact portion 45*a* of the handle 45 is in contact with the knob 46, the knob return spring 50 biases the knob 46 towards the draw-out side, and the knob 46 is pushed by the pushing portion 55 provided at the first feed cassette 4*a*. Accordingly, when the knob 46 and the handle 45 are accommodated in the conveying unit 40, if the pushing portion 55 no longer pushes the knob 46, then the knob 46 moves to a position where the knob 46 can be manually rotated and the handle 45 moves to a position where the operator can grasp the handle 45.

Therefore, by simply pushing the knob 46 and/or stopping the pushing of the knob 46, it is possible to accommodate the knob 46 and the handle member 45 and/or to manually rotate the knob 46 and to grasp the handle member 45. In particular, since the pushing of the knob 46 and the stopping of the pushing of the knob 46 can be performed by mounting and removing the first feed cassette 4*a*, it is possible to more easily accommodate the knob 46 and the handle 45, manually rotate the knob 46, and grasp the handle 45. In addition, since the conveying unit 40 can be disposed in the first feed cassette 4*a*, the body of the apparatus can be further reduced in size.

However, as long as the conveying unit 40 is disposed in the sheet conveying path of the body of the apparatus, its disposition is not particularly limited. For example, the conveying unit 40 may be disposed at the outer side of the first feed cassette 4*a*, or may be used in a conveying path other than in the reverse conveying path 21. In such a case, the disposition of the pushing portion 55 is also not particularly limited as long as the pushing portion 55 is disposed at a position where the pushing portion 55 can push the knob 46. For example, the pushing portion 55 can be provided at an inner surface of a side cover of the body of the apparatus.

When the handle 45 is formed so that the handle 45 opens around the rotating shaft 51 due to its own weight, it is not necessary to provide a member that presses the handle 45 in the direction in which the handle 45 opens. Accordingly, it is possible to open the handle 45 using a simpler structure. However, when the handle 45 is pressed by a biasing member, such as a coil spring, in the direction in which the handle 45 opens, the handle 45 can be more easily opened.

Since the handle moving member 47 has the inclined portion 47*c*, it is possible to prevent the handle moving member 47 from interfering with the contact portion 45*d*, so that the members such as the handle moving member 47 are prevented from becoming damaged, and the handle 45 is easily opened and closed. However, for example, the shape of the handle moving member 47 and the contact portion 45*d* can be suitably set in accordance with, for example, the structure of the apparatus as long as the handle 45 can be made movable in response to the movement of the knob 46. Therefore, the structure of the handle moving member 47 and the contact portion 45*d* is not particularly limited. In addition, the inclined portion 47*a* may obviously be omitted.

It is also possible to form a structure in which the contact portion 45*d* is not provided, and an end of the rotating shaft 51 at the rear plate 45*a* of the handle 45 is directly pushed by the handle moving member 47. The structure of the knob return spring 50 is not particularly limited as long as the knob return spring 50 can bias the knob 46 towards the draw-out side. For example, it is possible to form a structure in which the handle moving member 47 is pulled from the draw-out side by a tension spring. Further, the pushing portion 55 is not a required structural element. A structure in which the knob 46 is manually pushed may be provided. Further, the unit body 41 maybe provided with an engaging portion that engages the handle moving member 47 when the knob 46 is pushed in, and that can disengage from the handle moving member 47 when the knob 46 is drawn out.

The present invention is not limited to the above-described embodiments, and various modifications can be made without departing from the gist of the present invention. For example, although a copying machine is used as an example of the image forming apparatus, the present invention is obviously also applicable to other image forming apparatuses, such as a facsimile machine. In addition, although the presently described embodiments referred to electrophotography as an example, the present invention is not limited thereto. Therefore, the present invention is applicable to other image forming apparatuses, such as an inkjet image forming apparatus or a thermal-transfer image forming apparatus. Further, the present invention is widely applicable to, for example, a device that simply conveys sheets or a device that performs a post-processing operation on, for example, sheets on which images have been formed.

The present invention is applicable to the sheet conveying unit as long as the sheet conveying unit can be drawn out from the housing of the image forming apparatus. The pushing portion that pushes the knob may be provided at an external cover of the image forming apparatus that covers the sheet conveying unit in the direction in which the sheet conveying unit is removed.

What is claimed is:

1. A recording medium conveying device comprising:

a body portion capable of being mounted to and removed from a body of an apparatus in a direction perpendicular to a conveying direction of a recording medium, the body portion being provided with a plurality of conveying rollers that convey the recording medium;

a rotatable knob member disposed at a side at which the body portion is removed, the knob member allowing rotation of a conveying roller within the plurality of conveying rollers; and a handle member for mounting the body portion to and removing the body portion from the body of the apparatus, wherein the handle member is held so as to move between a first position and a second position, the first position being where the handle member is positioned when the handle member is accommodated in the body portion, the second position being where the handle member projects from the body portion towards the side at which the body portion is removed, wherein the knob member is connected to a rotating shaft of the conveying roller so as to move along a direction in which the body portion is removed, the direction being axial to the rotating shaft, and wherein the handle member moves to the first position in response to an accommodation operation of the knob member and to the second position in response to a draw-out operation of the knob member.

2. The recording medium conveying device according to claim 1, wherein the handle member includes a contact portion, the recording medium conveying device further comprising:

a handle moving member that moves the handle member to the first position by pushing the contact portion during the accommodation operation of the knob member; and biasing means for biasing the knob member towards a draw-out side.

3. The recording medium conveying device according to claim 2, wherein, when a pushing portion pushes the knob member, the accommodation operation of the knob member is executed against a biasing force of the biasing means and the handle member is moved to the first position by the handle moving member pushing the contact portion, and when the pushing portion releases from the knob member, the draw-out operation of the knob member is executed using the biasing force of the biasing means and the handle member is moved to the second position.

4. The recording medium conveying device according to claim 2, wherein an end of the rotating shaft opposite the conveying roller has mounted thereon the biasing means, the handle moving member, and the knob member, in respective order from nearest to furthest in relation to the conveying roller.

5. The recording medium conveying device according to claim 1, wherein the handle member has an associated weight that causes the handle member to move to the second position during the draw-out operation.

6. The recording medium conveying device according to claim 3, wherein the pushing portion is provided at a sheet stacking section provided at the body of the apparatus, and wherein mounting the sheet stacking section to the body of the apparatus causes the knob member to be pushed, and wherein removing the sheet stacking section from the body of the apparatus causes the knob member to be released.

7. The recording medium conveying device according to claim 2, wherein the handle moving member moves between a first movement restricting portion and a second movement restricting portion, the first and second movement restricting portions being provided at the body portion.

8. The recording medium conveying device according to claim 2, wherein, when the handle member is positioned at the first position, the contact portion, provided at the handle member, comes into contact with a handle movement restricting portion, provided at the body portion, to restrict movement of the handle member.

9. An image forming apparatus comprising:

a recording medium feeding section that feeds a recording medium;

a recording medium conveying section including a recording medium conveying device that conveys the recording medium;

an image forming section that forms an image on the recording medium conveyed by the recording medium conveying section; and a recording medium discharging section to which the recording medium having the image formed thereon is discharged, wherein the recording medium conveying device comprises:

a body portion capable of being mounted to and removed from a body of the apparatus in a direction perpendicular to a conveying direction of a recording medium, the body portion being provided with a plurality of conveying rollers that convey the recording medium;

a rotatable knob member disposed at a side at which the body portion is removed, the knob member allowing rotation of a conveying roller within the plurality of conveying rollers; and a handle member for mounting the body portion to and removing the body portion from the body of the apparatus, wherein the handle member is held so as to move between a first position and a second position, the first position being where the handle member is accommodated in the body portion, the second position being where the handle member projects from the body portion towards the side at which the body portion is removed, wherein the knob member is connected to a rotating shaft of the conveying roller so as to move along a direction in which the body portion is removed, the direction being axial to the rotating shaft, and wherein the handle member moves to the first position in response to an accommodation operation of the knob member and to the second position in response to a draw-out operation of the knob member.

10. The image forming apparatus according to claim 9, wherein the handle member includes a contact portion, the image forming device further comprising:

a handle moving member that moves the handle member to the first position by pushing the contact portion during the accommodation operation of the knob member; and biasing means for biasing the knob member towards a draw-out side.

11. The image forming apparatus according to claim 10, wherein, when a pushing portion pushes the knob member, the accommodation operation of the knob member is executed against a biasing force of the biasing means and the handle member is moved to the first position by the handle moving member pushing the contact portion, and when the pushing portion releases from the knob member, the draw-out operation of the knob member is executed using the biasing force of the biasing means and the handle member is moved to the second position.

12. The image forming apparatus according to claim 10, wherein an end of the rotating shaft opposite the conveying roller has mounted thereon the biasing means, the handle moving member, and the knob member, in respective order from nearest to furthest in relation to the conveying roller.

13. The image forming apparatus according to claim 9, wherein the handle member has an associated weight that causes the handle member to move to the second position during the draw-out operation of the knob member.

14. The image forming apparatus according to claim 11, wherein the pushing portion is provided at a sheet stacking section provided at the body of the apparatus, and wherein mounting the sheet stacking section to the body of the apparatus causes the knob member to be pushed, and wherein removing the sheet stacking section from the body of the apparatus causes the knob member to be released.

15. The image forming apparatus according to claim 10, wherein the handle moving member moves between a first movement restricting portion and a second movement restricting portion, the first and second movement restricting portions being provided at the body portion.

16. The image forming apparatus according to claim 10, wherein, when the handle member is positioned at the first position, the contact portion, provided at the handle member, comes into contact with a handle movement restricting portion, provided at the body portion, to restrict movement of the handle member.

17. A recording medium conveying device for an image forming apparatus having a feed cassette with a pushing portion associated therewith, the recording medium conveying device comprising:

a knob member actuable by the pushing portion to be accommodated when the pushing portion pushes the knob member and to be drawn-out when the pushing portion stops pushing the knob member, wherein the pushing portion pushes the knob member when the feed cassette is installed in the image forming apparatus, wherein the pushing portion stops pushing the knob member when the feed cassette is drawn-out from the image forming apparatus, and wherein the knob member is mounted to a rotating shaft of a conveying roller; and a handle member moved in response to the movement of the knob member along the rotating shaft of the conveying roller to be closed when the knob member is accommodated and to be open when the knob member is drawn-out, wherein the handle member is used to draw-out the recording medium conveying device, thereby allowing a jam elimination operation to be performed by rotating the knob member.

18. The recording medium conveying device according to claim 17, wherein the handle member pivots on a rotatable shaft in respond to the movement of the knob member along the rotating shaft of the conveying roller.

19. The recording medium conveying device according to claim 18, the recording medium conveying device further comprising;

a handle moving member that moves the handle member to the first position by pushing the contact portion during the accommodation operation of the knob member; wherein the handle moving member moves between a first movement restricting portion and a second movement restricting portion, the first and second movement restricting portions also limiting the extent to which the knob member can be accommodated and drawn-out.

20. The recording medium conveying device according to claim 19, wherein the rotating shaft has mounted thereon a knob return spring to provide a biasing force against the knob being accommodated and assisting the knob being drawn-out.

* * * * *